US010692437B2

(12) United States Patent
Liu

(10) Patent No.: US 10,692,437 B2
(45) Date of Patent: Jun. 23, 2020

(54) GOA CIRCUITRY UNIT, GOA CIRCUIT AND DISPLAY PANEL

(71) Applicant: Wuhan China Star Optoelectronics Semiconductor Display Technology Co., Ltd., Wuhan, Hubei (CN)

(72) Inventor: Jie Liu, Guangdong (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 186 days.

(21) Appl. No.: 15/754,241

(22) PCT Filed: Jan. 4, 2018

(86) PCT No.: PCT/CN2018/071300
§ 371 (c)(1),
(2) Date: Feb. 21, 2018

(87) PCT Pub. No.: WO2019/109446
PCT Pub. Date: Jun. 13, 2019

(65) Prior Publication Data

US 2019/0385533 A1 Dec. 19, 2019

(30) Foreign Application Priority Data

Dec. 6, 2017 (CN) ..... 2017 1 1282840

(51) Int. Cl.
*G09G 3/3266* (2016.01)

(52) U.S. Cl.
CPC ... *G09G 3/3266* (2013.01); *G09G 2300/0408* (2013.01); *G09G 2310/0202* (2013.01); *G09G 2310/08* (2013.01)

(58) Field of Classification Search
CPC ..... G09G 3/3266; G09G 3/3674
See application file for complete search history.

(56) References Cited

U.S. PATENT DOCUMENTS

2018/0102102 A1* 4/2018 Su ..... G09G 3/3674
2019/0066597 A1* 2/2019 Lan ..... G09G 3/3266

FOREIGN PATENT DOCUMENTS

| | | | |
|---|---|---|---|
| CN | 102708795 | A | 10/2012 |
| CN | 103268749 | A | 8/2013 |
| CN | 105185318 | A | 12/2015 |
| CN | 106952602 | A | 7/2017 |
| KR | 10-0685842 | B1 | 2/2007 |

* cited by examiner

*Primary Examiner* — Abdul-Samad A Adediran
(74) *Attorney, Agent, or Firm* — Hemisphere Law, PLLC; Zhigang Ma

(57) ABSTRACT

A gate driver on array (GOA) circuitry unit comprises a scan part and an inverter. The output terminal of the scan part is connected to the inverter, and an emission signal is generated after the scan signal output by the scan part passes through the inverter. Because the inverter is used for generating the emission signal, extra thin film transistors (TFT's) and capacitors are not necessary for generating the emission signal, number of TFT and capacitor is reduced, and narrow border design is benefit therefrom. A GOA circuit using the GOA circuitry unit, a display and a driving method for the GOA circuitry unit are also provided.

15 Claims, 7 Drawing Sheets

GOA CIRCUITRY UNIT, GOA CIRCUIT AND DISPLAY PANEL

RELATED APPLICATIONS

The present application is a National Phase of International Application Number PCT/CN2018/071300, filed Jan. 4, 2018, and claims the priority of China Application No. 201711282840.1, filed Dec. 6, 2017.

FIELD OF THE DISCLOSURE

The disclosure relates to a gate driver on array (GOA) circuitry unit, a GOA circuit using the GOA circuitry unit and a display panel using the GOA circuit.

BACKGROUND

A gate driver on array (GOA) circuit for driving pixel circuit is usually used for replacing an external chip in the display technique field. The GOA circuit is manufactured by forming gate driver ICs on the pixel substrate (also known as array substrate) by using array substrate process. Because the external chip is replaced by the GOA circuit, the number of procedure in manufacturing display apparatus and the manufacturing cost are reduced. At the same time, because the GOA circuit is to manufacture the gate driver ICs on the array substrate, the integration of the display apparatus is increased.

The GOA circuit is formed by connecting a plurality of GOA circuitry unit in cascade, and each of the GOA circuitry unit drives at least one pixel line on the array substrate for displaying. The GOA circuitry unit provides two kinds of signals:

(1) scan signal (SCAN), for turning on the thin film transistors (TFT's) connecting to the pixel line in a time period so that scanned data signals can be input to the capacitors in the circuits of the pixel line, and turning off the TFT's in other time periods so that the capacitors are not affected by scanning the data lines thereafter. The scan signals further initialize the potentials of the capacitors before inputting the scanned data signals to the capacitors or initialize anodes of the organic light-emitting diodes (OLED's).

(2) emission signal (EM), for driving some TFT's when the scan signal turns on the TFT's connecting to the pixel line, so that the OLED's are prevented from emitting light when inputting the scanned data signals or initializing to allow to input the scanned data signals accurately.

Therefore, the GOA circuitry unit generally comprises two independent parts, i.e., SCAN circuitry part and EM circuitry part. The SCAN circuitry part provides SCAN signals, and the EM circuitry part provides EM signals. Each circuitry part comprises TFT's and capacitors of itself. Accordingly, the whole GOA circuitry unit and the cascaded GOA circuit comprise more and more TFT's and capacitors and are harmful for narrow border design of the display device because the GOA circuit is usually designed to be arranged at boundary of the array substrate of the display device. At the same time, the independent two circuitry parts result in output phase mismatching.

SUMMARY

Accordingly, it is necessary to provide a gate driver on array (GOA) circuitry unit and GOA circuit, wherein each GOA circuitry unit integrates the scan circuitry part and the emission circuitry part into a united circuit structure, so that the number of thin film transistor (TFT) and capacitor is reduced, the design of narrow border is benefit therefrom, the output signals are stable and output phase mismatching is decreased.

In one aspect, the disclosure provides a GOA circuitry unit, wherein the GOA circuitry unit comprises a scan part and an inverter, an output terminal of the scan part is connected to the inverter, the scan part outputs a scan signal, the scan signal is output to the inverter for generating an emission signal; the inverter comprises: a tenth thin film transistor (TFT), an eleventh TFT, a twelfth TFT, a thirteenth TFT, a third capacitor, a first clock signal terminal, a second clock signal terminal, a high potential terminal and a low potential terminal; a gate terminal of the tenth TFT is connected to the output terminal of the scan part, a source terminal of the tenth TFT is connected to the high potential terminal, and a drain terminal of the tenth TFT is connected to a gate terminal of the thirteenth TFT; a gate terminal of the eleventh TFT is connected to the output terminal of the scan part, a source terminal of the eleventh TFT is connected to the high potential terminal, and a drain terminal of the eleventh TFT is used as an output terminal of the inverter; a gate terminal of the twelfth TFT is connected to the first clock signal terminal, a source terminal of the twelfth TFT is connected to the low potential terminal and the second clock signal terminal, and a drain terminal of the twelfth TFT is connected to the gate terminal of the thirteenth TFT; a source terminal of the thirteenth TFT is connected to the low potential terminal and the second clock signal terminal, and a drain terminal of the thirteenth TFT is used as the output terminal of the inverter; and one terminal of the third capacitor is connected to the gate terminal of the thirteenth TFT, and another one terminal of the third capacitor is connected to the source terminal of the thirteenth TFT.

In one embodiment, the scan part comprises: a first TFT, a second TFT, a third TFT, a fourth TFT, an eighth TFT, a ninth TFT, a first capacitor, a second capacitor, a pulse signal input terminal, a third clock signal terminal, a pull-down node and a pull-up node; a gate terminal of the first TFT is connected to the first clock signal terminal, a source terminal of the first TFT is connected to the pulse signal input terminal, and a drain terminal of the first TFT is connected to a gate terminal of the third TFT; a gate terminal of the second TFT is connected to the third clock signal terminal, a source terminal of the second TFT is connected to the low potential terminal, and a drain terminal of the second TFT is connected to a drain terminal of the third TFT; a source terminal of the third TFT is connected to the high potential terminal; a gate terminal of the fourth TFT is connected to the third clock signal terminal, a source terminal of the fourth TFT is connected to the high potential terminal, and a drain terminal of the fourth TFT is connected to the gate terminal of the third TFT and the pull-down node; a gate terminal of the eighth TFT is connected to the pull-up node, a source terminal of the eighth TFT is connected to the high potential terminal, and a drain terminal of the eighth TFT is used as the output terminal of the scan part; the gate terminal and the source terminal of the eighth TFT are connected to two terminals of the first capacitor, respectively; a gate terminal of the ninth TFT is connected to the pull-down node, a source terminal of the ninth TFT is connected to the second clock signal terminal, and a drain terminal of the ninth TFT is used as the output terminal of the scan part; and the gate terminal and the drain terminal of the ninth TFT are connected to two terminals of the second capacitor, respectively.

In one embodiment, the scan part further comprises a seventh TFT arranged between the pull-down node and the first TFT, a gate terminal of the seventh TFT is connected to the low potential terminal, a source terminal of the seventh TFT is connected to the pull-down node, and a drain terminal of the seventh TFT is connected to the drain terminal of the first TFT.

In one embodiment, the scan part further comprises a fifth TFT, a gate terminal of the fifth TFT is connected to the pull-up node, a source terminal of the fifth TFT is connected to the drain terminal of the seventh TFT, and a drain terminal of the fifth TFT is connected to the high potential terminal.

In one embodiment, the scan part further comprises a sixth TFT, a gate terminal of the sixth TFT is connected to the second clock signal terminal, a source terminal of the sixth TFT is connected to the high potential terminal, and a drain terminal of the sixth TFT is connected to the drain terminal of the fifth TFT.

In one embodiment, the first to thirteenth TFT's are P-type TFT's.

The present disclosure further provides a GOA circuit comprising the GOA circuitry unit above.

The present disclosure further provides a display panel. The display panel comprises a plurality of pixel lines and a plurality of the GOA circuitry units above, and each of the pixel lines is connected to and driven by one of the GOA circuitry units.

An inverter described above is added to the scan part so that, when the scan signal is generated by the scan part, the emission signal is generated at the same time by passing the scan signal generated by the scan part through the inverter. Because the emission signal is generated by using the inverter, extra TFT's and capacitors are not necessary for generating the emission signal, number of TFT and capacitor is reduced, the design of narrow border is benefit therefrom, the output signals are stable and output phase mismatching is decreased.

BRIEF DESCRIPTION OF THE DRAWINGS

In order to make the descriptions of the technique solutions of the embodiments of the present invention or the existed techniques, the drawings necessary for describing the embodiments or the existed techniques are briefly introduced below. Obviously, the drawings described below are only some embodiments of the present invention, and, for those with ordinary skill in this field, other drawings can be obtained from the drawings described below without creative efforts.

Figure 1:
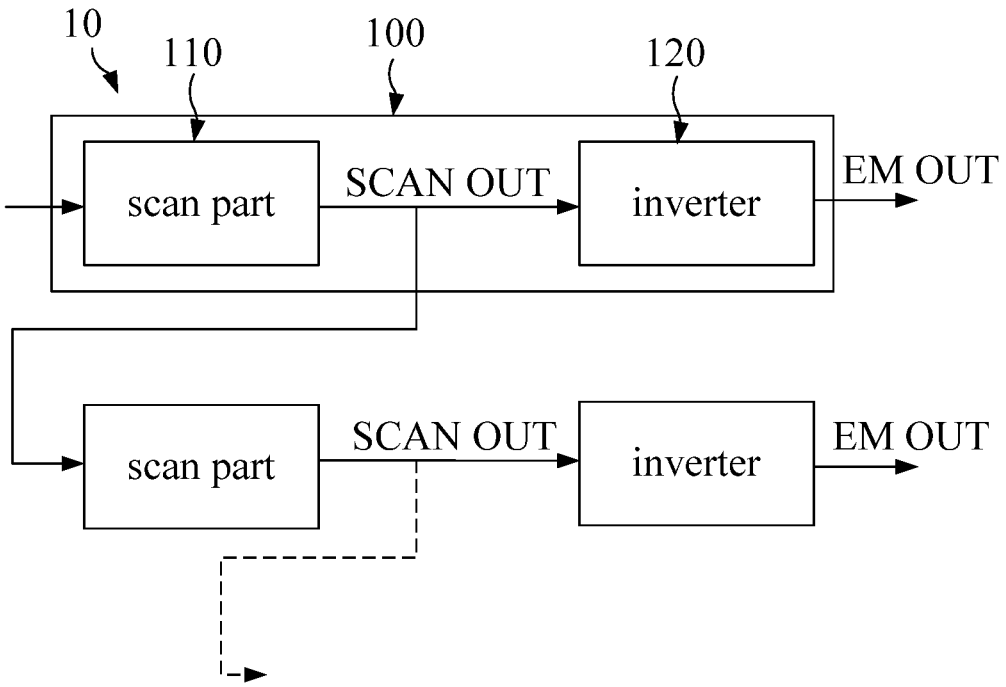
FIG. 1 is a schematic circuit diagram of the GOA circuit according to one embodiment of the disclosure.

Realization of the objects, function, features and advantages of the disclosure are further described as follows in combination with embodiments while referring to the drawings.

DETAILED DESCRIPTION OF PREFERRED EMBODIMENTS

The technical solutions in the embodiments of the present disclosure are clearly and completely described with reference to the accompanying drawings in the embodiments of the present disclosure. Apparently, the described embodiments are merely a part but not all of the embodiments of the present disclosure. In the case of no conflict, the features in the following embodiments and examples can be combined with each other. All other embodiments obtained by a person of ordinary skill in the art based on the embodiments of the present disclosure without creative efforts shall be within the protection scope of this application.

Unless defined otherwise, all technical and scientific terms used herein have the same meaning as commonly understood by one with ordinary skill in the art to which this application belongs. The terminology used in the specification of the present disclosure is for the purpose of describing particular embodiments only but not intends to limit the application.

Figure 4:
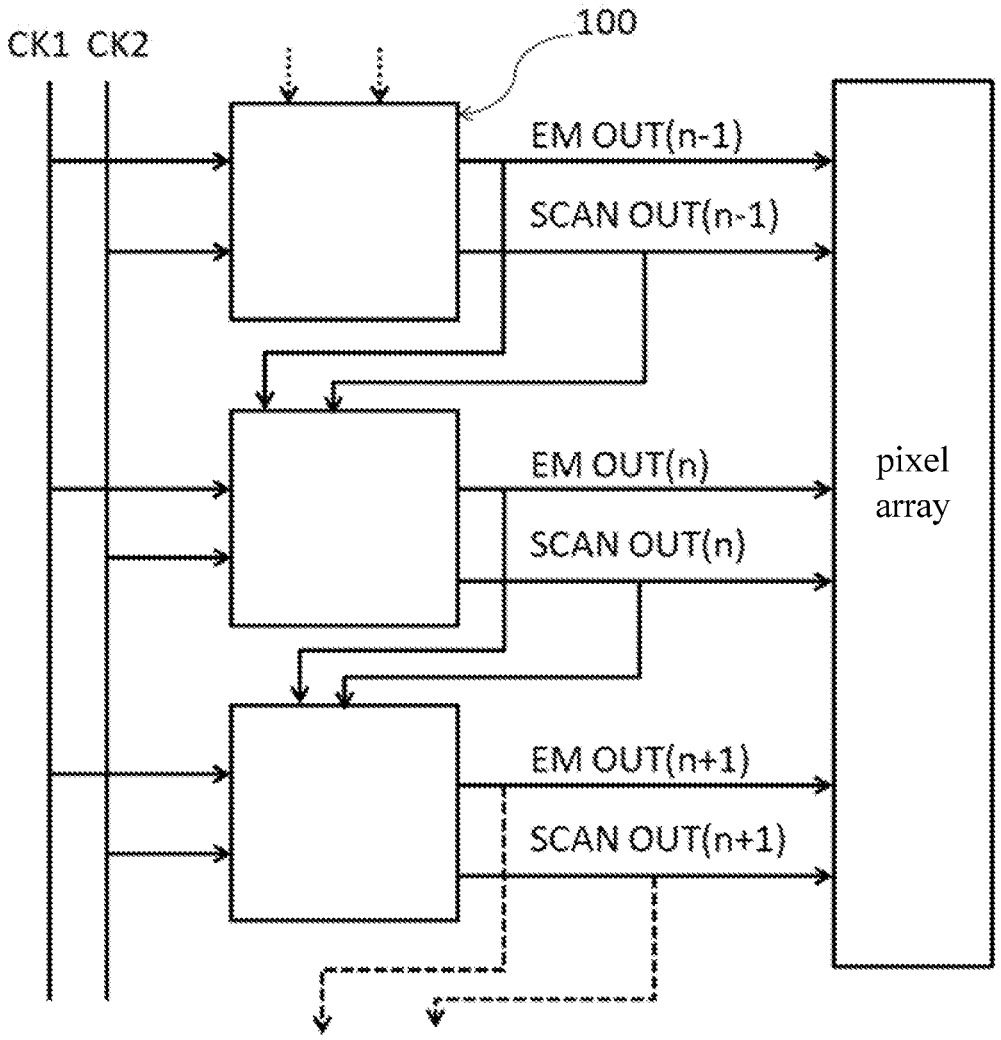
FIG. 4 is an application schematic diagram of the GOA circuit according to one embodiment of the disclosure.

Please refer to FIG. 1 and FIG. 4, in the present disclosure, a gate driver on array (GOA) circuit 10 comprises a plurality of GOA circuitry units 100 connected in cascade. Each GOA circuitry unit 100 drives at least one pixel line on the array substrate for displaying and corresponds to at least one scan line. Wherein, a plurality of pixels are arranged in lines and columns on the array substrate of a display panel to form a pixel array. In the present embodiment, each GOA circuitry unit 100 is connected to one scan line and corresponds to one pixel line. The output terminal of each GOA circuitry unit 100 is connected to one pixel line, and, at the same time, is connected to the input terminal of a next GOA circuitry unit 100 to turn on the next GOA circuitry unit 100. For example, the output terminal of the nth GOA circuitry unit 100 is connected to a pixel line and the input terminal of the next ((n+1)th) GOA circuitry unit 100; and the input terminal of the nth GOA circuitry unit 100 is connected to the output terminal of the previous ((n−1)th) GOA circuit unit 100, as shown in FIG. 4, wherein, n is a natural number not less than 1.

The display panel could be, for example, the organic light emitting diode display panel (OLED panel) or liquid crystal display panel (LCD panel), preferably an OLED panel, and most preferably a flexible OLED panel.

Figure 2:
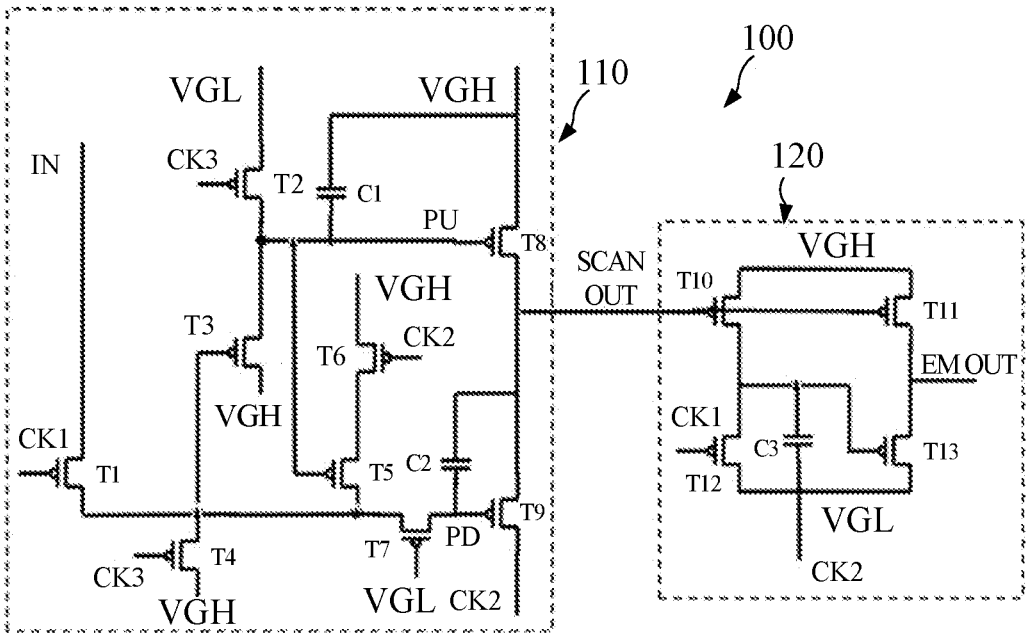
FIG. 2 is a schematic circuit diagram of the GOA circuitry unit shown in FIG. 1.

Please refer to FIG. 2 together, FIG. 2 is a schematic circuit diagram of the GOA circuitry unit. Each GOA circuitry unit 100 comprises a scan (SCAN) part 110 and an inverter 120. The SCAN part 110 and the inverter 120 together to generate the EM signal, and the SCAN part 110 further generates the SCAN signal.

As shown in FIG. 1, the output terminal SCAN OUT of each SCAN part 110 is connected to the input terminal of the inverter 120 of the same GOA circuitry unit 100, and the output terminal SCAN OUT is also connected to the input terminal of the SCAN part 110 of the next GOA circuitry unit 100. The output terminal EM OUT of each inverter 120 is connected to one pixel line. The output terminal SCAN OUT of the SCAN part 110 outputs the SCAN signal, and the output terminal EM OUT of the inverter 120 outputs the EM signal.

Furthermore, referring to FIG. 2 again, the SCAN part 110 comprises the first thin film transistor (TFT) T1, the second TFT T2, the third TFT T3, the fourth TFT T4, the fifth TFT T5, the sixth TFT T6, the seventh TFT T7, the eighth TFT T8, the ninth TFT T9, the first capacitor C1, the second capacitor C2, the pulse signal input terminal IN, the first cloak signal terminal CK1, the second clock signal terminal CK2, the third clock signal terminal CK3, the high potential terminal VGH, the low potential terminal VGL, the pull-down node PD and the pull-up node PU.

The gate terminal of the first TFT T1 is connected to the first clock signal terminal CK1, the source terminal of the first TFT T1 is connected to the pulse signal input terminal IN, and the drain terminal of the first TFT T1 is connected to the gate terminal of the third TFT T3. The first TFT T1 is controlled to turn on or off by the first clock signal terminal CK1.

The gate terminal of the second TFT T2 is connected to the third clock signal terminal CK3, the source terminal of the second TFT T2 is connected to the low potential terminal VGL, and the drain terminal of the second TFT T2 is connected to the drain terminal of the third TFT T3. The second TFT T2 is controlled to turn on or off by the third clock signal terminal CK3.

The gate terminal of the third TFT T3 is connected to the drain terminal of the first TFT T1 and the drain terminal of the fourth TFT T4, and the source terminal of the third TFT T3 is connected to the high potential terminal VGH.

The gate terminal of the fourth TFT T4 is connected to the third clock signal terminal CK3, the source terminal of the fourth TFT T4 is connected to the high potential terminal VGH, and the drain terminal of the fourth TFT T4 is connected to the first TFT T1, third TFT T3 and the drain of the seventh TFT T7. The fourth TFT T4 is controlled to turn on or off by the third clock signal terminal CK3.

The gate terminal of the fifth TFT T5 is connected to the pull-up node PU, the source terminal of the fifth TFT T5 is connected to the drain terminal of the seventh TFT T7, and the drain terminal of the fifth TFT is connected to the drain terminal of the sixth TFT T6.

The gate terminal of the sixth TFT T6 is connected to the second clock signal terminal CK2, the source terminal of the sixth TFT T6 is connected to the high potential terminal VGH, and the drain terminal of the sixth TFT T6 is connected to the drain terminal of the fifth TFT T5. The sixth TFT T6 is controlled to turn on or off by the second clock signal terminal CK2.

The gate terminal of the seventh TFT T7 is connected to the low potential terminal VGL, the source terminal of the seventh TFT T7 is connected to the pull-down node PD, and the drain terminal of the seventh TFT T7 is connected to the drain terminal of the first TFT T1. In the embodiment, the seventh TFT T7 is always turned on because a low potential is always input from the low potential terminal VGL.

The gate terminal of the eighth TFT T8 is connected to the pull-up node PU, the source terminal of the eighth TFT T8 is connected to the high potential terminal VGH, and the drain terminal of the eighth TFT T8 is used as the output terminal SCAN OUT of the SCAN part 110. One terminal of the first capacitor C1 is connected to the gate terminal of the eighth TFT T8, another terminal of the first capacitor C1 is connected to the source terminal of the eighth TFT T8. The eighth TFT T8 is controlled to turn on or off by the pull-up node PU.

The gate terminal of the ninth TFT T9 is connected to the pull-down node PD, the source terminal of the ninth TFT T9 is connected to the second clock signal terminal CK2, and the drain terminal of the ninth TFT T9 is used as the output terminal SCAN OUT of the SCAN part 110. One terminal of the second capacitor C2 is connected to the gate terminal of the ninth TFT T9, and another terminal of the second capacitor C2 is connected to the drain terminal of the ninth TFT T9. The ninth TFT T9 is controlled to turn on or off by the pull-down node PD.

In the embodiment, the first to ninth TFT's T1~T9 are all positive channel Metal Oxide Semiconductor (PMOS) transistors, that is, the first to ninth TFT's T1~T9 are all P-type TFT's, and the reset signal is effective when it is low potential, i.e., the TFT is turned on when the gate terminal receives low potential.

Furthermore, referring to FIG. 2 again, the inverter 120 comprises the tenth TFT T10, the eleventh TFT T11, the twelfth TFT T12, the thirteenth TFT T13 and the third capacitor C3.

The gate terminal of the tenth TFT T10 is connected to the output terminal SCAN OUT of the SCAN part 110, the source terminal of the tenth TFT T10 is connected to the high potential terminal VGH, and the drain terminal of the tenth TFT T10 is connected to the drain terminal of the twelfth TFT T12. The tenth TFT T10 is controlled to turn on or off by the output terminal SCAN OUT of the SCAN part 110.

The gate terminal of the eleventh TFT T11 is connected to the output terminal SCAN OUT of the SCAN part 110, the source terminal of the eleventh TFT T11 is connected to the high potential terminal VGH, and the drain terminal of the eleventh TFT T11 is connected to the drain terminal of the thirteenth TFT T13 as is used as the output terminal EM OUT of the inverter 120. The eleventh TFT T11 is controlled to turn on or off by the output terminal SCAN OUT of the SCAN part 110.

The gate terminal of the twelfth TFT T12 is connected to the first clock signal terminal CK1, the source terminal of the twelfth TFT T12 is connected to the low potential terminal VGL and the second clock signal terminal CK2, and the drain terminal of the twelfth TFT T12 is connected to the gate terminal of the thirteenth TFT T13 and the drain terminal of the tenth TFT T10. The twelfth TFT T12 is controlled to turn on or off by the first clock signal terminal CK1.

The gate terminal of the thirteenth TFT T13 is connected to the drain terminal of the tenth TFT T10, the source terminal of the thirteenth TFT T13 is connected to the low potential terminal VGL and the second clock signal terminal CK2, and the drain terminal of the thirteenth TFT T13 is used as the output terminal EM OUT of the inverter 120. One terminal of the third capacitor C3 is connected to the gate terminal of the thirteenth TFT T13, and another terminal of the third capacitor C3 is connected to the second clock signal terminal CK2 and the low potential terminal VGL.

Figure 3:
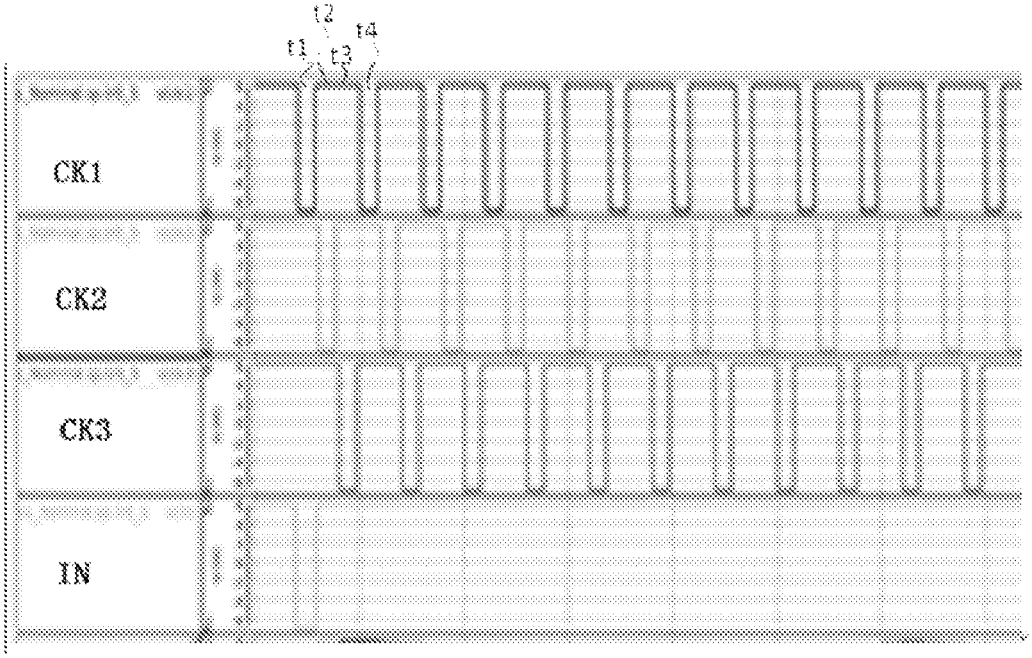
FIG. 3 is a timing sequence schematic diagram of the GOA circuitry unit shown in FIG. 2.

Please also refer to FIG. 3, the pulse signal input terminal IN inputs signals to the first one of the GOA circuitry units 100 of the GOA circuit 10 to turn on the first one of the GOA circuitry units 100, and, at the same time, the first clock signal terminal CK1, the second clock signal terminal CK2 and the third clock signal terminal CK3 input signals and the GOA circuit 10 starts to work. The working procedure of the GOA circuitry unit 100 is:

In the first time period t1, the pulse signal input terminal IN is at a low potential, the first clock signal terminal CK1 is at the low potential, the second clock signal terminal CK2 is at the potential, and the third clock signal terminal CK3 is at a high potential.

Because the first clock signal terminal CK1 is at the low potential, the first TFT T1 and the twelfth TFT T12 are both turned on. Because the pulse signal input terminal IN is at the low potential, the low potential signal at the pulse signal input terminal IN is transmitted to the third TFT T3 through the first TFT T1, and the third TFT T3 is turned on, too. The source terminal of the third TFT T3 is connected to the high potential terminal VGH so that the pull-up node PU is at the high potential and the eighth TFT T8 is turned off thereby.

Because the seventh TFT T7 is always turned on, the low potential signal at the pulse signal input terminal IN is transmitted to the pull-down node PD through the first TFT T1 so that the pull-down node PD is at the low potential, the ninth TFT T9 is turned on, and the second capacitor C2 begins to be charged. The high potential at the second clock signal terminal CK2 is output from the output terminal SCAN OUT of the SCAN part 110 through the ninth TFT T9. Therefore, at this time, the output terminal SCAN OUT of the SCAN part 110 is at the high potential.

Because the first TFT T1 is with a threshold voltage Vth(T1), the voltage of the pull-down node PD is the sum of the initial voltage V0 of the pulse signal input terminal IN and the threshold voltage Vth(T1), i.e., Vpd=V0+Vth(T1).

The output terminal SCAN OUT of the SCAN part 110 is at the high potential so that the tenth TFT T10 and eleventh TFT T11 are both turned off. The twelfth TFT T12 is turned on so that the gate voltage of the thirteenth TFT T13 is the sum of V0 and the threshold voltage Vth(T12) of the twelfth TFT T12, i.e., V0+Vth(T12), which is still at the low potential. Therefore, the thirteenth TFT T13 is turned on, the output of the output terminal EM OUT of the inverter 120 is at the low potential, and the third capacitor C3 begins to be charged.

In the second time period t2, the pulse signal input terminal IN is at the high potential, the first clock signal terminal CK1 is at the high potential, the second clock signal terminal CK2 is at the low potential, and the third clock signal terminal CK3 is at the high potential.

Because the first clock signal terminal CK1 is at the high potential, the first TFT T1 and the twelfth TFT T12 are turned off. The third clock signal terminal CK3 is at the high potential so that the eighth TFT T8 is still turned off. The second clock signal terminal CK2 is at the low potential so that the sixth TFT T6 is turned on. Because of the effect of the second capacitor C2, the pull-down node PD is pulled to a lower potential so that the ninth TFT T9 is still turned on and the output terminal SCAN OUT of the SCAN part 110 is at the low potential.

Because the output terminal SCAN OUT of the SCAN part 110 is at the low potential, the tenth TFT T10 and the eleventh TFT T11 are both turned on. Because the first clock signal terminal is at the high potential, the twelfth TFT T12 is turned off, and, because of the effect of the third capacitor C3, the thirteenth TFT T13 is turned off. The high potential at the high potential terminal VGH is transmitted to the output terminal EM OUT of the inverter 120 through the eleventh TFT T11 so that the output terminal EM OUT of the inverter 120 is at the high potential.

In the third time period t3, the pulse signal input terminal IN is at the high potential, the first clock signal terminal CK1 is at the high potential, the second clock signal terminal is at the high potential, and the third clock signal terminal is at the low potential.

Because the third clock signal terminal CK3 is at the low potential, the second TFT T2 and the fourth TFT T4 are turned on. Because the fourth TFT T4 is turned on, the pull-down node PD is at the high potential and the ninth TFT T9 is turned off thereby. Because the second TFT T2 is turned on, the pull-up node PU is at the low potential and the voltage of the pull-up node PU is V0+Vth(T2). Therefore, the eighth TFT T8 is turned on and the output terminal SCAN OUT of the SCAN part 110 is at the high potential.

Because the output terminal SCAN OUT of the SCAN part 110 is at the high potential, the tenth TFT T10 and the eleventh TFT T11 are turned off. Because the twelfth TFT T12 is turned off and the potential of the gate terminal of the thirteenth TFT T13 is pulled up by the effect of the third capacitor C3, the thirteenth TFT T13 is also turned off thereby. The output terminal EM OUT of the inverter 120 is kept at the high potential as the previous time period (the second time period t2).

In the fourth time period t4, the pulse signal input terminal is at the high potential, the first clock signal terminal CK1 is at the low potential, the second clock signal terminal CK2 is at the high potential, and the third clock signal terminal CK3 is at the high potential.

Because the first clock signal terminal CK1 is at the low potential, the first TFT T1 is turned off so that the high potential at the pulse signal input terminal IN is transmitted to the pull-down node PD through the first TFT T1. Because the pull-down PD is pulled to the high potential, the ninth TFT T9 is turned off.

Because the third clock signal terminal is at the high potential, the second TFT T2 and the fourth TFT T4 are turned off and the pull-up node PU is kept at the low potential as the previous time period under the effect of the first capacitor C1. Therefore, the eighth TFT T8 is turned on, and the output terminal SCAN OUT of the SCAN part 110 is at the high potential.

Because the output terminal SCAN OUT of the SCAN part 110 is at the high potential, the tenth TFT T10 and the eleventh TFT T11 is turned off. The first clock signal terminal CK1 is at the low potential so that the twelfth TFT T12 is turned on and the low potential at the low potential terminal VGL is transmitted to the gate terminal of the thirteenth TFT T13 through the twelfth TFT T12 to turn on the thirteenth TFT T13. The low potential at the low potential terminal VGL is transmitted to the output terminal EM OUT of the inverter 120 through the thirteenth TFT T13, so that the output terminal EM OUT of the inverter 120 is at the low potential.

The inverter 120 is added to the SCAN part 110 so that, when the SCAN signal is generated by the SCAN part 110, the EM signal is generated at the same time by combining the SCAN signal generated from the SCAN part 110 with the inverter 120. Therefore, extra TFT's and capacitors are not necessary for generating the EM signal, number of TFT and capacitor is reduced, the design of narrow border is benefit therefrom, and the output signals are stable and output phase mismatching is decreased because the SCAN signal and the EM signal are not output from two circuits independent from each other. In addition, because the seventh TFT T7 is always connected to the low potential terminal VGL and is therefore always turned on when the GOA circuit 10 works, leaking current is reduced and the potential of the pull-down node PD is stabilized thereby.

Figure 5:
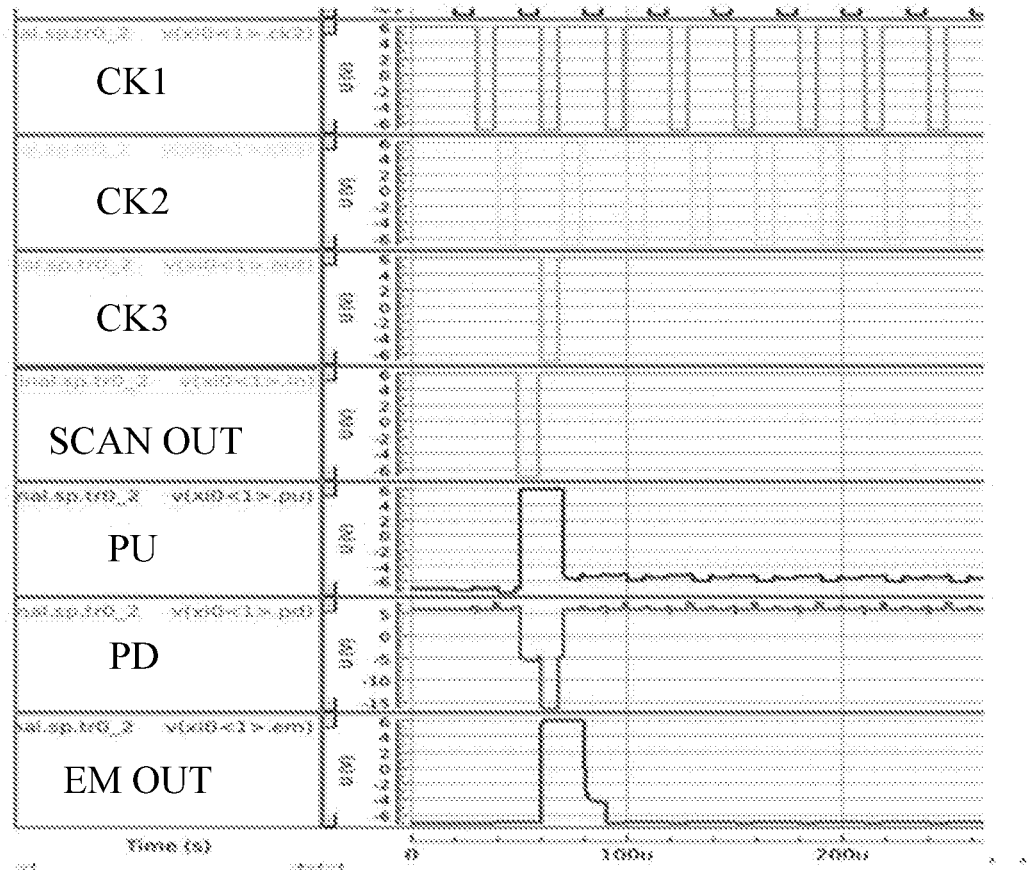
FIG. 5 is a node potential schematic diagram of the GOA circuitry unit in operation in level 1 simulation.

FIG. 5 is a node potential schematic diagram of the GOA circuitry unit 100 in operation in level 1 simulation. It can be found that the GOA circuitry unit 100 is capable of simultaneously outputting the EM signal while outputting the SCAN signal normally.

Figure 6:
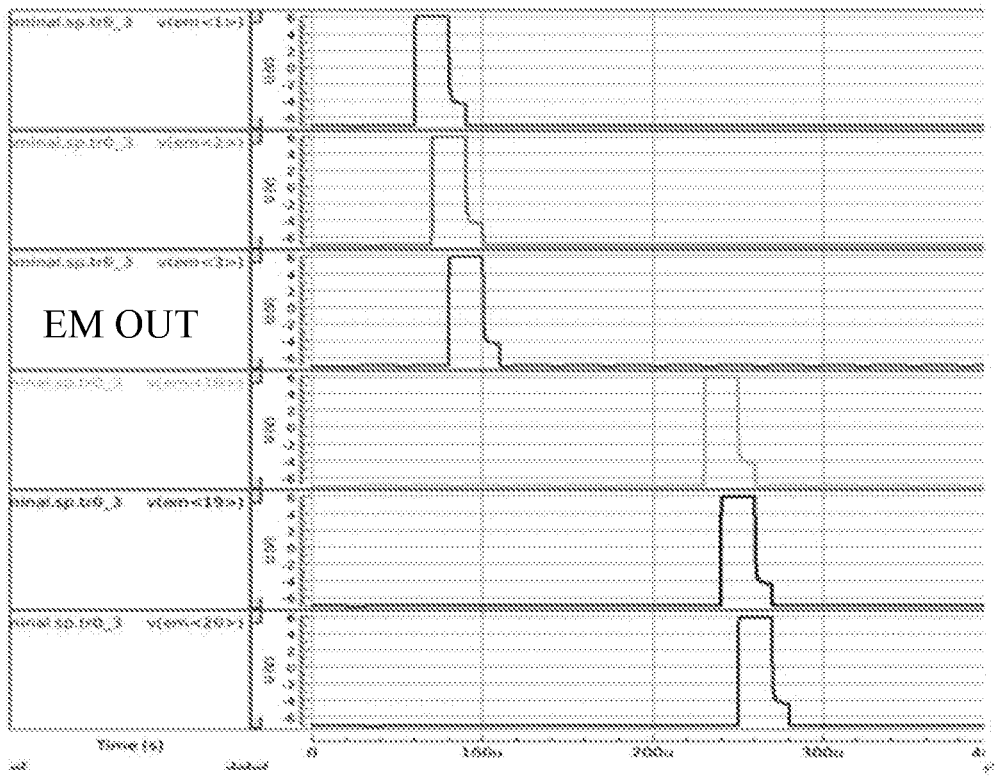
FIG. 6 is an EM signal output schematic diagram of the GOA circuitry unit in operation in level 20 simulation.
Figure 7:
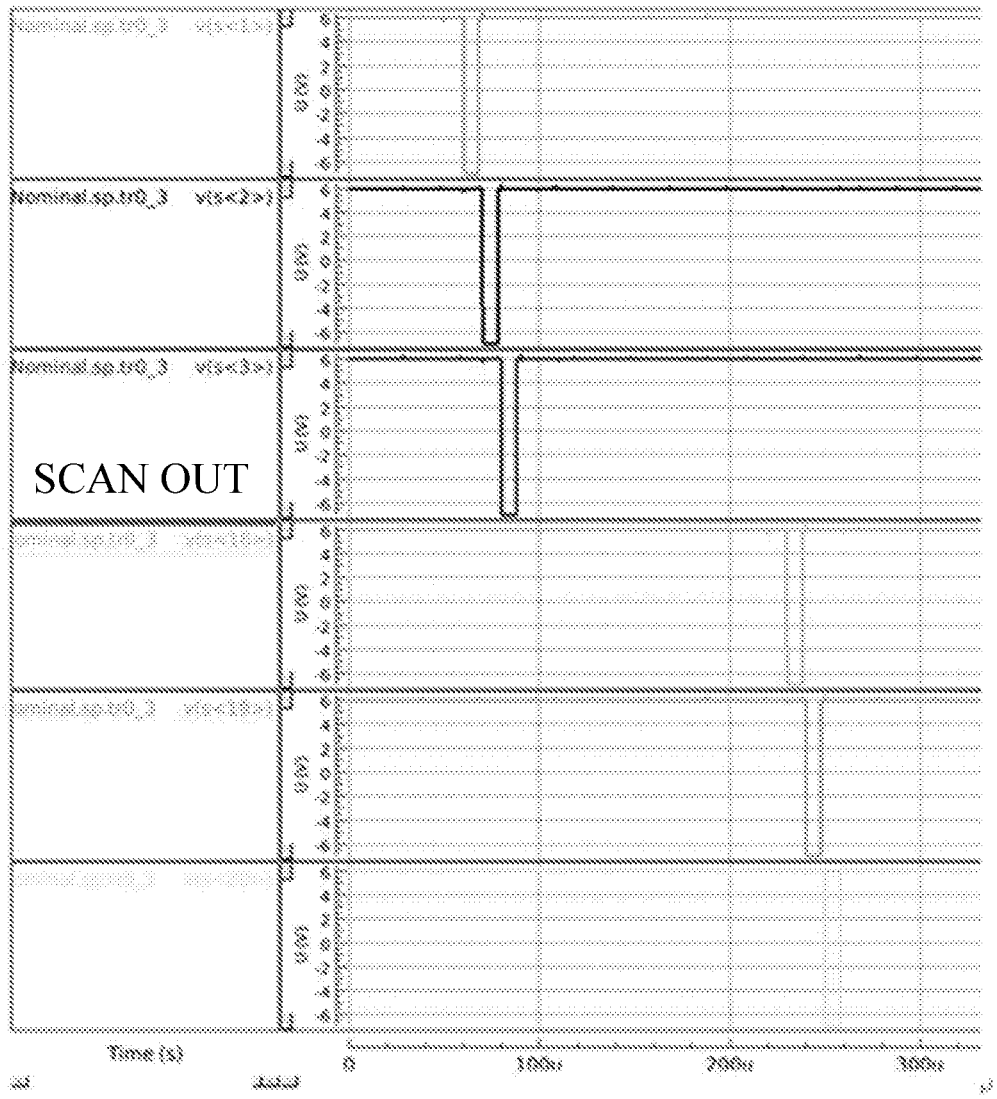
FIG. 7 is a SCAN signal output schematic diagram of the GOA circuitry unit in operation in level 20 simulation.

FIG. 6 is the EM signal output schematic diagram of the GOA circuitry unit in operation in level 20 simulation. FIG. 7 is the SCAN signal output schematic diagram of the GOA circuitry unit in operation in level 20 simulation. It can be found that, output and transmittance of the SCAN signal and the EM signal are normal and more stabilized in level 20 simulation of the GOA circuitry unit 100.

The foregoing contents are detailed description of the disclosure in conjunction with specific preferred embodiments and concrete embodiments of the disclosure are not limited to the description. For the person skilled in the art of the disclosure, without departing from the concept of the disclosure, simple deductions or substitutions can be made and should be included in the protection scope of the application.

What is claimed is:

1. A gate driver on array (GOA) circuitry unit, wherein the GOA circuitry unit comprises a scan part and an inverter, an output terminal of the scan part is connected to the inverter, the scan part outputs a scan signal, the scan signal is output to the inverter for generating an emission signal; the inverter comprises: a tenth thin film transistor (TFT), an eleventh TFT, a twelfth TFT, a thirteenth TFT, a third capacitor, a first clock signal terminal, a second clock signal terminal, a high potential terminal and a low potential terminal; a gate terminal of the tenth TFT is connected to the output terminal of the scan part, a source terminal of the tenth TFT is connected to the high potential terminal, and a drain terminal of the tenth TFT is connected to a gate terminal of the thirteenth TFT; a gate terminal of the eleventh TFT is connected to the output terminal of the scan part, a source terminal of the eleventh TFT is connected to the high potential terminal, and a drain terminal of the eleventh TFT is used as an output terminal of the inverter; a gate terminal of the twelfth TFT is connected to the first clock signal terminal, a source terminal of the twelfth TFT is connected to the low potential terminal and the second clock signal terminal, and a drain terminal of the twelfth TFT is connected to the gate terminal of the thirteenth TFT; a source terminal of the thirteenth TFT is connected to the low potential terminal and the second clock signal terminal, and a drain terminal of the thirteenth TFT is used as the output terminal of the inverter; and one terminal of the third capacitor is connected to the gate terminal of the thirteenth TFT, and another one terminal of the third capacitor is connected to the source terminal of the thirteenth TFT;

wherein the scan part comprises: a first TFT, a second TFT, a third TFT, a fourth TFT, an eighth TFT, a ninth TFT, a first capacitor, a second capacitor, a pulse signal input terminal, a third clock signal terminal, a pull-down node and a pull-up node; a gate terminal of the first TFT is connected to the first clock signal terminal, a source terminal of the first TFT is connected to the pulse signal input terminal, and a drain terminal of the first TFT is connected to a gate terminal of the third TFT; a gate terminal of the second TFT is connected to the third clock signal terminal, a source terminal of the second TFT is connected to the low potential terminal, and a drain terminal of the second TFT is connected to a drain terminal of the third TFT; a source terminal of the third TFT is connected to the high potential terminal; a gate terminal of the fourth TFT is connected to the third clock signal terminal, a source terminal of the fourth TFT is connected to the high potential terminal, and a drain terminal of the fourth TFT is connected to the gate terminal of the third TFT and the pull-down node; a gate terminal of the eighth TFT is connected to the pull-up node, a source terminal of the eighth TFT is connected to the high potential terminal, and a drain terminal of the eighth TFT is used as the output terminal of the scan part; the gate terminal and the source terminal of the eighth TFT are connected to two terminals of the first capacitor, respectively; a gate terminal of the ninth TFT is connected to the pull-down node, a source terminal of the ninth TFT is connected to the second clock signal terminal, and a drain terminal of the ninth TFT is used as the output terminal of the scan part; and the gate terminal and the drain terminal of the ninth TFT are connected to two terminals of the second capacitor, respectively.

2. The GOA circuitry unit according to claim 1, wherein the scan part further comprises a seventh TFT arranged between the pull-down node and the first TFT, a gate terminal of the seventh TFT is connected to the low potential terminal, a source terminal of the seventh TFT is connected to the pull-down node, and a drain terminal of the seventh TFT is connected to the drain terminal of the first TFT.

3. The GOA circuitry unit according to claim 2, wherein the scan part further comprises a fifth TFT, a gate terminal of the fifth TFT is connected to the pull-up node, a source terminal of the fifth TFT is connected to the drain terminal of the seventh TFT, and a drain terminal of the fifth TFT is connected to the high potential terminal.

4. The GOA circuitry unit according to claim 3, wherein the scan part further comprises a sixth TFT, a gate terminal of the sixth TFT is connected to the second clock signal terminal, a source terminal of the sixth TFT is connected to the high potential terminal, and a drain terminal of the sixth TFT is connected to the drain terminal of the fifth TFT.

5. The GOA circuitry unit according to claim 4, wherein the first to thirteenth TFT's are P-type TFT's.

6. A gate driver on array (GOA) circuit, comprising at least one GOA circuitry unit, each of the at least one GOA circuitry comprises a scan part and an inverter, an output terminal of the scan part is connected to the inverter, the scan part outputs a scan signal, the scan signal is output to the inverter for generating an emission signal; the inverter comprises: a tenth thin film transistor (TFT), an eleventh TFT, a twelfth TFT, a thirteenth TFT, a third capacitor, a first clock signal terminal, a second clock signal terminal, a high potential terminal and a low potential terminal; a gate terminal of the tenth TFT is connected to the output terminal of the scan part, a source terminal of the tenth TFT is connected to the high potential terminal, and a drain terminal of the tenth TFT is connected to a gate terminal of the thirteenth TFT; a gate terminal of the eleventh TFT is connected to the output terminal of the scan part, a source terminal of the eleventh TFT is connected to the high potential terminal, and a drain terminal of the eleventh TFT is used as an output terminal of the inverter; a gate terminal of the twelfth TFT is connected to the first clock signal terminal, a source terminal of the twelfth TFT is connected to the low potential terminal and the second clock signal terminal, and a drain terminal of the twelfth TFT is connected to the gate terminal of the thirteenth TFT; a source terminal of the thirteenth TFT is connected to the low potential terminal and the second clock signal terminal, and a drain terminal of the thirteenth TFT is used as the output terminal of the inverter; and one terminal of the third capacitor is connected to the gate terminal of the thirteenth TFT, and another one terminal of the third capacitor is connected to the source terminal of the thirteenth TFT;

wherein the scan part comprises: a first TFT, a second TFT, a third TFT, a fourth TFT, an eighth TFT, a ninth TFT, a first capacitor, a second capacitor, a pulse signal input terminal, a third clock signal terminal, a pull-down node and a pull-up node; a gate terminal of the first TFT is connected to the first clock signal terminal, a source terminal of the first TFT is connected to the pulse signal input terminal, and a drain terminal of the first TFT is connected to a gate terminal of the third TFT; a gate terminal of the second TFT is connected to the third clock signal terminal, a source terminal of the second TFT is connected to the low potential terminal, and a drain terminal of the second TFT is connected to a drain terminal of the third TFT; a source terminal of the third TFT is connected to the high potential terminal; a gate terminal of the fourth TFT is connected to the third clock signal terminal, a source terminal of the fourth TFT is connected to the high potential terminal, and a drain terminal of the fourth TFT is connected to the gate terminal of the third TFT and the pull-down node; a gate terminal of the eighth TFT is connected to the pull-up node, a source terminal of the eighth TFT is connected to the high potential terminal, and a drain terminal of the eighth TFT is used as the output terminal of the scan part; the gate terminal and the source terminal of the eighth TFT are connected to two terminals of the first capacitor, respectively; a gate terminal of the ninth TFT is connected to the pull-down node, a source terminal of the ninth TFT is connected to the second clock signal terminal, and a drain terminal of the ninth TFT is used as the output terminal of the scan part; and the gate terminal and the drain terminal of the ninth TFT are connected to two terminals of the second capacitor, respectively.

7. The GOA circuit according to claim 6, wherein the scan part further comprises a seventh TFT arranged between the pull-down node and the first TFT, a gate terminal of the seventh TFT is connected to the low potential terminal, a source terminal of the seventh TFT is connected to the pull-down node, and a drain terminal of the seventh TFT is connected to the drain terminal of the first TFT.

8. The GOA circuit according to claim 7, wherein the scan part further comprises a fifth TFT, a gate terminal of the fifth TFT is connected to the pull-up node, a source terminal of the fifth TFT is connected to the drain terminal of the seventh TFT, and a drain terminal of the fifth TFT is connected to the high potential terminal.

9. The GOA circuit according to claim 8, wherein the scan part further comprises a sixth TFT, a gate terminal of the sixth TFT is connected to the second clock signal terminal, a source terminal of the sixth TFT is connected to the high potential terminal, and a drain terminal of the sixth TFT is connected to the drain terminal of the fifth TFT.

10. The GOA circuit according to claim 9, wherein the first to thirteenth TFT's are P-type TFT's.

11. A display panel, comprising a plurality of pixel lines and at least one gate driver on array (GOA) circuitry unit, each of the pixel lines being connected to and driven by one of the at least one GOA circuitry unit;

wherein, the GOA circuitry unit comprises a scan part and an inverter, an output terminal of the scan part is connected to the inverter, the scan part outputs a scan signal, the scan signal is output to the inverter for generating an emission signal; the inverter comprises: a tenth thin film transistor (TFT), an eleventh TFT, a twelfth TFT, a thirteenth TFT, a third capacitor, a first clock signal terminal, a second clock signal terminal, a high potential terminal and a low potential terminal; a gate terminal of the tenth TFT is connected to the output terminal of the scan part, a source terminal of the tenth TFT is connected to the high potential terminal, and a drain terminal of the tenth TFT is connected to a gate terminal of the thirteenth TFT; a gate terminal of the eleventh TFT is connected to the output terminal of the scan part, a source terminal of the eleventh TFT is connected to the high potential terminal, and a drain terminal of the eleventh TFT is used as an output terminal of the inverter; a gate terminal of the twelfth TFT is connected to the first clock signal terminal, a source terminal of the twelfth TFT is connected to the low potential terminal and the second clock signal terminal, and a drain terminal of the twelfth TFT is connected to the gate terminal of the thirteenth TFT; a source terminal of the thirteenth TFT is connected to the low potential terminal and the second clock signal terminal, and a drain terminal of the thirteenth TFT is used as the output terminal of the inverter; and one terminal of the third capacitor is connected to the gate terminal of the thirteenth TFT, and another one terminal of the third capacitor is connected to the source terminal of the thirteenth TFT;

wherein the scan part comprises: a first TFT, a second TFT, a third TFT, a fourth TFT, an eighth TFT, a ninth TFT, a first capacitor, a second capacitor, a pulse signal input terminal, a third clock signal terminal, a pull-down node and a pull-up node; a gate terminal of the first TFT is connected to the first clock signal terminal, a source terminal of the first TFT is connected to the pulse signal input terminal, and a drain terminal of the first TFT is connected to a gate terminal of the third TFT; a gate terminal of the second TFT is connected to the third clock signal terminal, a source terminal of the second TFT is connected to the low potential terminal, and a drain terminal of the second TFT is connected to a drain terminal of the third TFT; a source pg,23 terminal of the third TFT is connected to the high potential terminal; a gate terminal of the fourth TFT is connected to the third clock signal terminal, a source terminal of the fourth TFT is connected to the high potential terminal, and a drain terminal of the fourth TFT is connected to the gate terminal of the third TFT and the pull-down node; a gate terminal of the eighth TFT is connected to the pull-up node, a source terminal of the eighth TFT is connected to the high potential terminal, and a drain terminal of the eighth TFT is used as the output terminal of the scan part; the gate terminal and the source terminal of the eighth TFT are connected to two terminals of the first capacitor, respectively; a gate terminal of the ninth TFT is connected to the pull-down node, a source terminal of the ninth TFT is connected to the second clock signal terminal, and a drain terminal of the ninth TFT is used as the output terminal of the scan part; and the gate terminal and the drain terminal of the ninth TFT are connected to two terminals of the second capacitor, respectively.

12. The display panel according to claim 11, wherein the scan part further comprises a seventh TFT arranged between the pull-down node and the first TFT, a gate terminal of the seventh TFT is connected to the low potential terminal, a source terminal of the seventh TFT is connected to the pull-down node, and a drain terminal of the seventh TFT is connected to the drain terminal of the first TFT.

13. The display panel according to claim 12, wherein the scan part further comprises a fifth TFT, a gate terminal of the fifth TFT is connected to the pull-up node, a source terminal of the fifth TFT is connected to the drain terminal of the seventh TFT, and a drain terminal of the fifth TFT is connected to the high potential terminal.

14. The display panel according to claim 13, wherein the scan part further comprises a sixth TFT, a gate terminal of the sixth TFT is connected to the second clock signal terminal, a source terminal of the sixth TFT is connected to the high potential terminal, and a drain terminal of the sixth TFT is connected to the drain terminal of the fifth TFT.

15. The display panel according to claim 14, wherein the first to thirteenth TFT's are P-type TFT's.

* * * * *